United States Patent [19]

Mittelbach

[11] Patent Number: 4,873,816

[45] Date of Patent: Oct. 17, 1989

[54] ARRANGEMENT FOR FITTING VALVE SACKS ON FILLING PIPE OF PACKAGING MACHINE

[75] Inventor: Helmut Mittelbach, Oelde, Fed. Rep. of Germany

[73] Assignee: Haver & Boecker, Oelde, Fed. Rep. of Germany

[21] Appl. No.: 142,801

[22] Filed: Jan. 7, 1988

[30] Foreign Application Priority Data

Jan. 8, 1987 [DE] Fed. Rep. of Germany ..... 3700345
May 13, 1987 [DE] Fed. Rep. of Germany ..... 3715926

[51] Int. Cl.[4] ..... B65B 43/26

[52] U.S. Cl. ..... 53/573; 53/386; 53/571; 493/125

[58] Field of Search ..... 53/573, 571, 567, 386, 53/459, 384; 493/125

[56] References Cited

U.S. PATENT DOCUMENTS

| | | | |
|---|---|---|---|
| 3,522,691 | 8/1970 | Adcox | 53/571 X |
| 3,785,414 | 1/1974 | Obara | 53/571 X |
| 3,943,687 | 3/1976 | Cerioni | 53/571 |
| 4,334,558 | 6/1982 | Durant | 53/571 X |
| 4,711,070 | 12/1987 | Massa et al. | 53/573 |

*Primary Examiner*—James F. Coan
*Attorney, Agent, or Firm*—Michael J. Striker

[57] ABSTRACT

An arrangement for fitting valve sacks on a filling pipe of a packaging machine comprises a unit for spreading a valve of valve sacks, the spreading unit being turnable about a horizontal axis so as to bring the valve of sacks in alignment with a filling pipe of a packaging machine, a unit forming a horizontal guide path for the spreading unit, and a unit for moving the spreading means along the horizontal guide path.

31 Claims, 6 Drawing Sheets

18
19
21
22
D
20
8a
29
C
8
20
19
22
D
17a

ARRANGEMENT FOR FITTING VALVE SACKS ON FILLING PIPE OF PACKAGING MACHINE

BACKGROUND OF THE INVENTION

The present invention relates to an arrangement for fitting of valve sacks on a filling pipe or filling pipes of a packaging machine. It deals for example with side fold valve sacks which are closed at their opposite sides with closing seams extending transversely to the longitudinal edges, and in which the valve is provided under a closing seam in one longitudinal side wall.

Arrangements of the above mentioned general type are known in the art. One of such arrangements is disclosed, for example in the PCT-Application No. WO/81/01543. In this document a spreading device which is composed of two semishells moves in this arrangement into the easily opened valve to pull the valve up so wide that it is fittable on the filling pipe. For pulling up the valve, one shell is turnable about a horizontal axis. After the valve has been pulled up the sack in the valve region is engaged by turnable guiding flaps. The shape of the guiding flaps corresponds to the contour of the pulled up valve, so that the valve cannot close. Then, the sack is fitted on the filling pipe by a respectively controlled movement of the guiding flaps. This arrangement is suitable exclusively for cross bottom valve sacks which are formed of several paper layers and have a relatively high rigidity.

The rigidity of flat sacks, side fold sacks is not comparable with that of the cross bottom sacks, especially in the case when the sacks are produced from a synthetic plastic foil. With the sacks in question it is not possible to maintain the shape of the pulled up valve by outwardly engaging guiding flaps. Moreover, because of the arrangement of the valve in the side wall under a closing seam, it is practically impossible to introduce the tool in the region of the valve. A further disadvantage of the above described known arrangement is that after the pulling up of the valve, a transfer is performed on the means by which the sack is fitted on the filling pipe.

SUMMARY OF THE INVENTION

Accordingly, it is an object of the present invention to provide an arrangement for fitting valve sacks on a filling pipe or filling pipes of a packaging machine, which avoids the disadvantages of the prior art.

More particularly, it is an object of the present invention to provide an arrangement of the above mentioned general type, which is provided with simple structural means and formed so that it can be used for all types of sacks and operate especially with flexible materials in a disturbance-free manner.

In keeping with these objects and with others which will become apparent hereinafter, one feature of the present invention resides, briefly stated, in an arrangement for fitting valve sacks on filling pipes of a packaging machine, in which the spreading means is turnable about a horizontal axis so that the valve of a sack is in alignment with the filling pipe, and the spreading device is movable along a horizontal guide path.

When the arrangement is designed in accordance with the present invention, the spreading device is simultaneously the fitting device, since after the transfer of the sack from the operating device in which the valve is easily opened, no further means for fitting are needed, with the exception of the drive for moving the spreading device.

In accordance with another feature of the present invention, the turning axis of the spreading device extends parallel to the guide path and at the distance from it, while the guide path extends parallel to a central longitudinal axis of the filling pipe. As a result of this, a simple construction and a simply controllable movement course are obtained, since the spreading device is turnable about the horizontal axis when it moves in direction towards the filling pipe.

For assuring that the spreading device for pulling up the valve and transporting the sack to the filling pipe can be simply inserted into the valve which has opened by the separating device, the spreading device is provided with two oppositely movable spreading fingers and at least one pulling up hook which is movable transversely to the movement direction of the spreading fingers. Thereby the pulled up valve obtains a substantially triangular shape. Since the filling pipe has conventionally a radius on its free end, a fitting is possible with no problems whatsoever.

In accordance with an advantageous embodiment of the invention, the arrangement is provided with a separating device which is arranged before the spreading device. The separating device substantially includes a horizontal table for receiving a stack of several flatly lying sacks, a vertically movable suction device for lifting the respective uppermost sack from the stack, and at least one pressing strip which is placeable on the stack of sacks in the region of valves and moves in synchronism with the table. The table is movable by means of a drive and a control at least transversely to the longitudinal edges of the sack in a horizontal plane, till at least the filling opening of the valve of the uppermost sack of the staple is in a proper position relative to the suction device.

Because of the provision of the separating device, the fitting device works without manual steps. A disturbance-free operation is insured when the sacks are stacked not in an edge-straight manner, since due to the movability of the table and thereby the stack of sacks lying on it for the removal of the respective uppermost sack from the stack, the sack to be removed is oriented by the suction device. The distance between the sack edges and the suction strip is thereby always identical, so that the subsequent tools arranged in a functional cooperation with one another can take over the sack. With this solution, the stack arranged on the table is not oriented, but instead each individual sack is brought to a nominal position for the taking over by the separating device. Since in view of the output of a filling machine the table is moved in relatively short intervals, the pressing strip or pressing strips are placed on the upper side of the stack of sacks for preventing that during movement of the table the sacks are displaced inside the stack. An orientation is impossible in the event of an uncontrollable displacement. Since the pressing strip or strips move in synchronism with the movement of the table, a relative movement between the stack of sacks and the table is avoided.

In accordance with a further embodiment of the separating device, the table is movable transverse to the longitudinal edges of the sack, two pressing strips are arranged and at a distance from one another, and each pressing strip lies at a relatively small distance from the filling opening of the valve and movable by a drive from the region of the suction device for taking over the sacks. This construction is designed for side fold valve sacks. In these sacks the filling opening of the valve lies parallel to and at a distance from the longitudinal edge of the sack, substantially in the region of the inner edge of the side fold. Thereby, it is sufficient when the table moves exclusively transversely to the longitudinal edges of the sack. It is then guaranteed that the tool arranged after the suction device can be inserted into the valve. Since the pressing strips lie in their operational position at both sides of the valve, the sack cannot cant or displace in the valve region. Since the pressing strips after the separation of a sack are moved out of the region of the suction device by the drive, the spreading tools required for transportation and fitting on the filling pipe can be introduced into the valve which is opened by the suction device without any problems.

This construction is further simplified when the pressing strips are arranged on the suction device. Each pressing strip is formed as a U-shaped rail, and a guiding roller is arranged on the suction device for each pressing strip so that the pressing strips run on the guiding roller. Since for separating of a sack the suction device is lowered onto the staple of sacks, no additional parts for the vertical movement of the pressing strips are needed. In view of the low rigidity of synthetic plastic sacks, it is advantageous when the suction device is provided with a suction plate with a plurality of suction openings so as to form a large gripping surface.

An output increase of the arrangement is achieved when the separating device is associated with an opening lever which is turnable about a horizontal axis and insertable with its free end into the pre-opened valve opening of the individual sack. With this opening lever, the separated sack can be later taken over by the spreading device, whereby the time consumption for fitting on the filling pipe of the packaging machine is respectively low.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a side view of the spreading arrangement of

DESCRIPTION OF A PREFERRED EMBODIMENT

Figure 1:
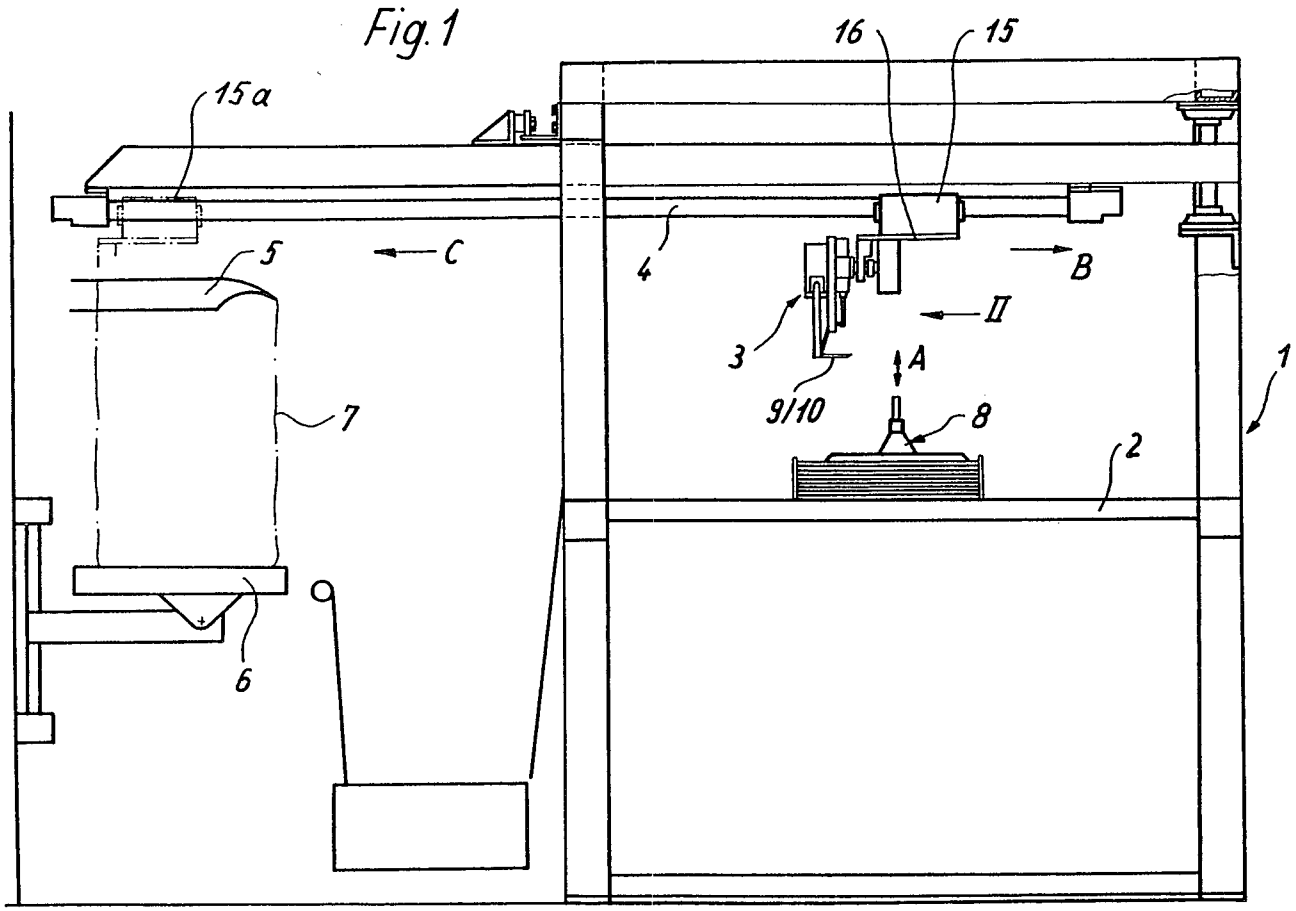
FIG. 1 is a view schematically showing an arrangement for fitting valve sacks on filling pipes of a packaging machine, in accordance with the present invention.
Figure 4:
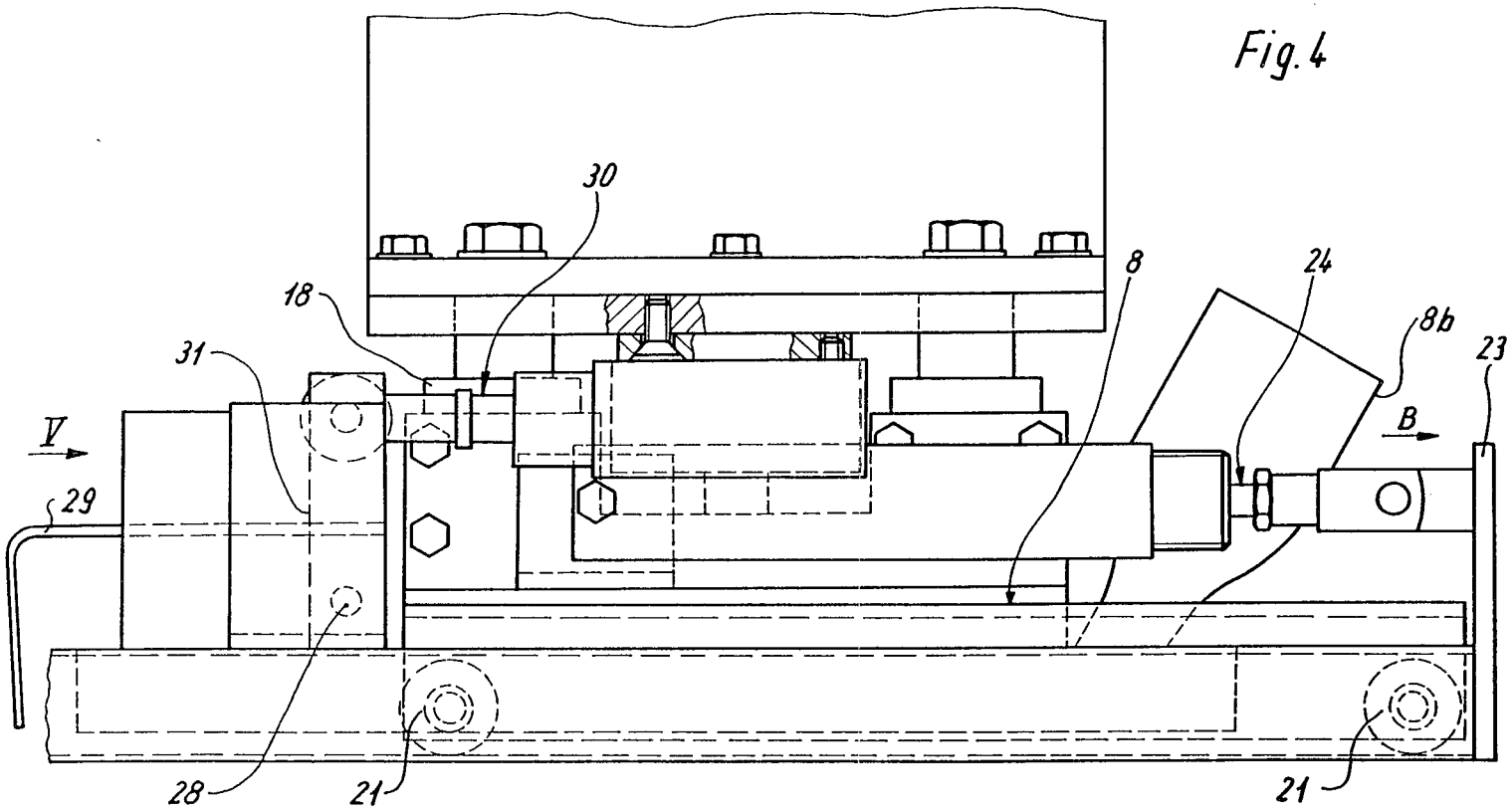
FIG. 4 is a view schematically showing a separating device of the inventive arrangement.
Figure 5:
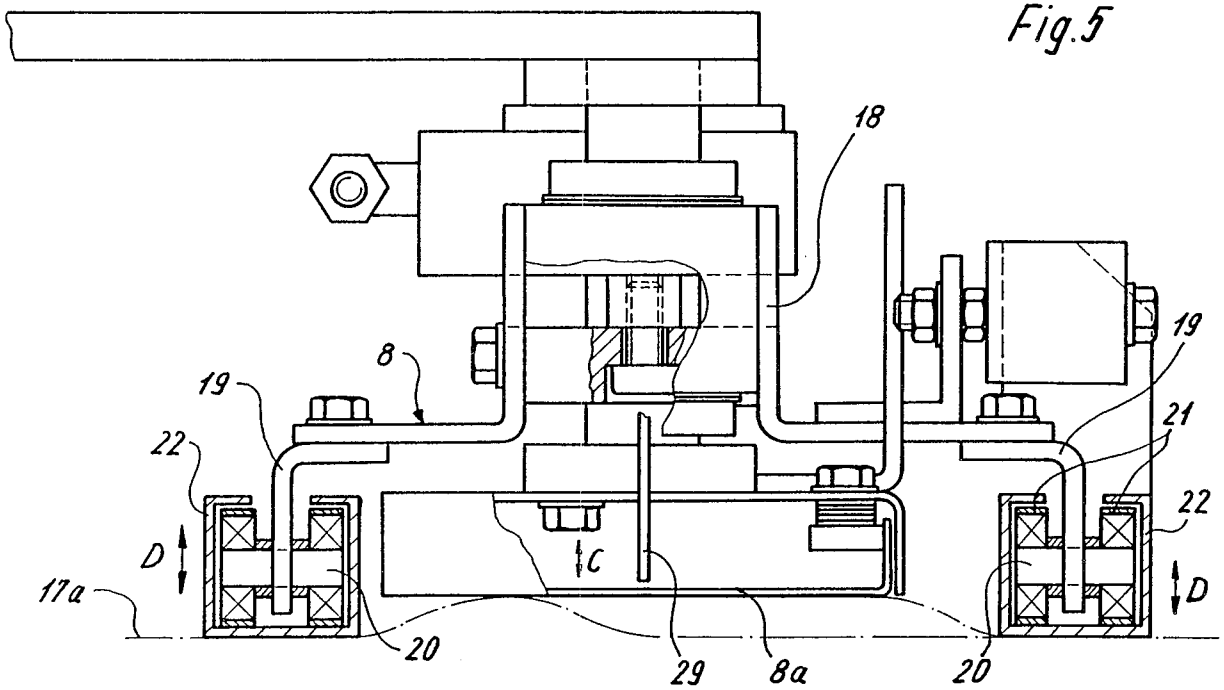
FIG. 5 is a side view of the separating arrangement of FIG. 4, as seen in direction of the arrow V in FIG. 4.
Figure 6:
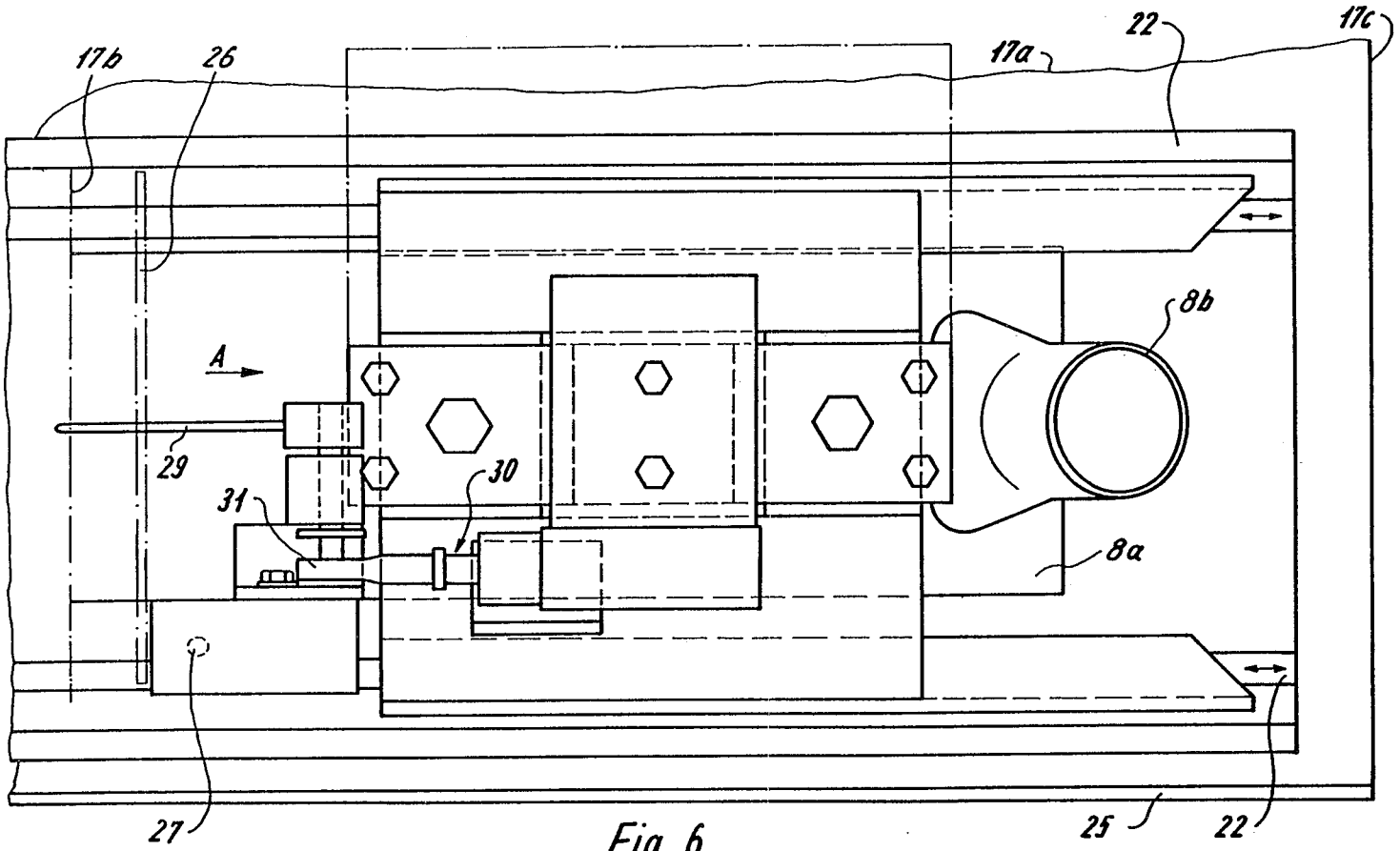
FIG. 6 is a plan view of the separating arrangement of FIG. 4.

The arrangement in accordance with the present invention shown in FIG. 1 substantially includes a frame 1, a table 2 for receiving a stack formed of a plurality of sacks, and a spreading device 3 which is movable along a guide path 4 above the table 2 and will be explained in detail hereinbelow. From the packaging machine, only a filling pipe 5 and a tilting saddle located under the filling pipe are shown. A sack 7 shown in dash-dot line and lying under the filling pipe is supported on the tilting saddle. As shown in FIG. 1, the horizontal guide path is located here at a relatively small distance above the filling pipe 5. The flatly lying sacks are removed from the stack by a separating arrangement which is shown in FIGS. 4–6. A suction device 4 of the separating arrangement is symbolically shown in FIG. 1 and is movable in a vertical direction as identified with the double arrow A. Under the action of the suction device 8, the valve is somewhat opened so that spreading fingers 9, 10 can be introduced into the valve. For this purpose the spreading device 3 is moved in direction of the arrow B. This movement increases the distance between the spreading device 3 and the filling pipe 5. It should be mentioned that the sacks are placed on the table 2 so that the valve lies at the side which faces toward the filling pipe 5. The spreading fingers 9, 10 have an angular shape with a free leg extending parallel to and at a distance from the guide path 4. After the spreading fingers 9 and 10 are introduced into the valve, they are moved away of one another.

Figure 2:
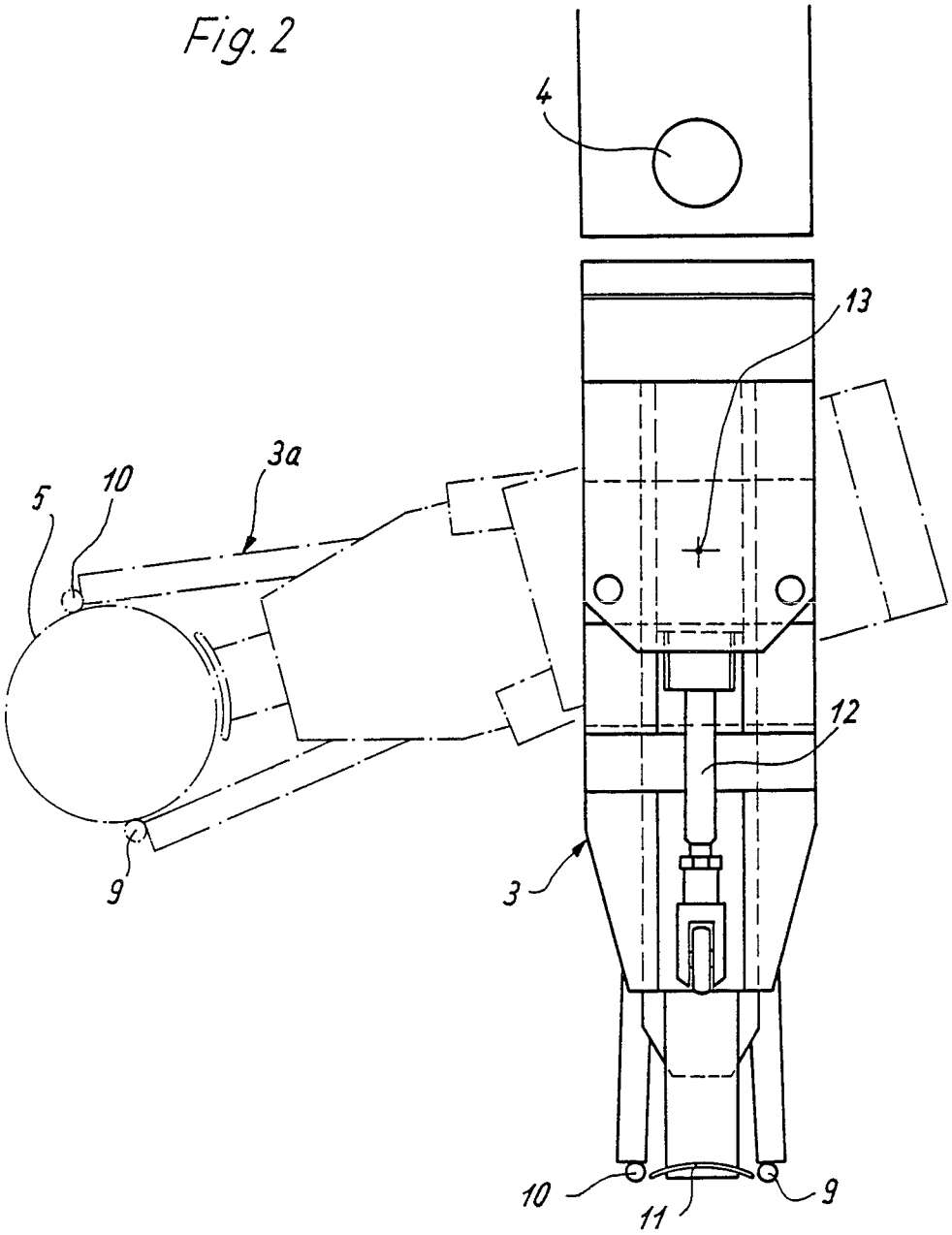
FIG. 2 is a view showing a spreading device of the inventive arrangement, as seen in direction of the arrow 2 in FIG. 1.

The spreading device 3 has, in addition to the spreading fingers 9, 10, a pulling up hook 11 which together with the spreading fingers 9, 10 is introduced into the valve. The pulling up hook 11 is displaceable transversely to the movement direction of the spreading fingers 9, 10, by means of a cylinder-piston unit 12 fixed on the spreading device 3. In the shown embodiment the free end of the pulling up hook 11, which is introduced into the valve, is curved to correspond to the contour of the filling pipe, as shown in FIG. 2. The movements of the spreading fingers 9, 10 as well as the pulling up hook 11 are so selected relative to one another that the sack is firmly taken up. The pulling up hook 11 can move in the event of the flatly lying sack in direction toward the guide path 4, while on the other hand, this is also possible when the sack to be filled is located directly before the filling pipe 5.

The spreading device 3 is then turned about a horizontal axis identified with reference numeral 13, in a clockwise direction in the shown embodiment. The turned position is identified in FIG. 2 with a reference 3a. The filling pipe is also shown in dash-dot lines. It can be recognized from the drawings that the spreading fingers 9, 10 and the pulling up hook 11 lie outside the outer contour of the filling pipe 5. The spreading device 3 is moved by a not shown drive in direction toward the filling pipe 5, as identified by the arrow C. The filling pipe 5 or the packaging machine is designed so that the spreading fingers 9, 10 and the pulling up hook 11 with the sack suspended thereon can pass by the filling pipe 5 and thereby the sack can be pulled onto the filling pipe 5.

The sack 7 is fixed on the filling pipe 5 at a predetermined location by a not shown plunger. After this, the spreading device 3 is moved so far in direction toward the packaging machine that the spreading fingers 9, 10 and the pulling up hook 11 are withdrawn from the valve. The movement direction of the spreading device 3 for receipt of a new sack is reversed.

The turning of the spreading device 3 must not be performed directly after the introduction of the spreading fingers 9, 10 into the valve. Instead, it can be performed during the movement in direction toward the filling pipe 5 or directly before the filling pipe 5.

Figure 3:
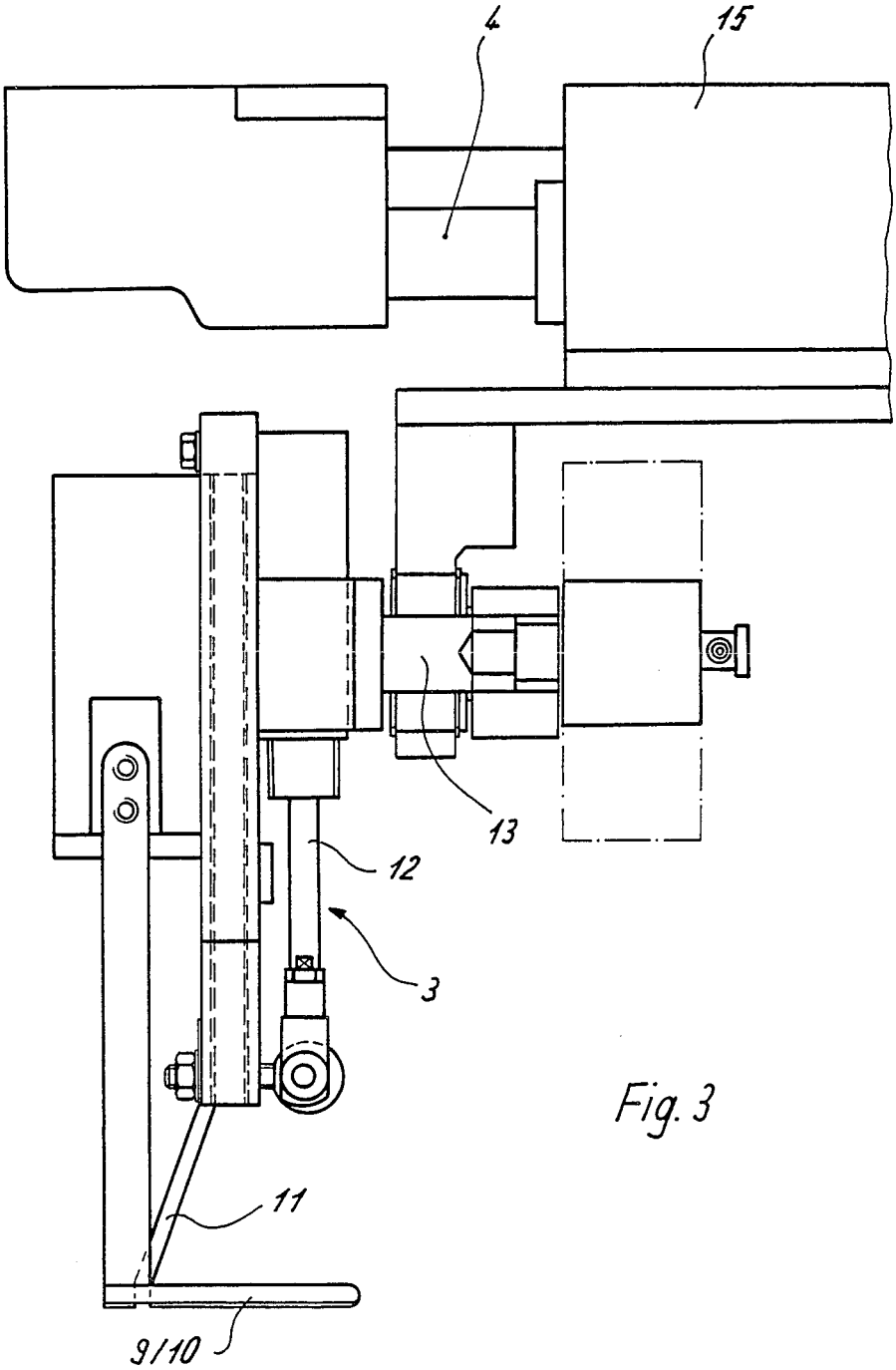

As can be seen from FIGS. 1 and 3, the guide path 4 is composed of a pipe or of a shaft which is supported on a horizontally extending traverse 14. A displacement sleeve 15 is arranged on the shaft or the pipe and secured against rotation. The displacement sleeve 15 is provided with a mounting plate 16 at its side which faces toward the table 2. The mounting plate 16 serves for mounting the spreading device 3. The end position of the displacement sleeve 15 after the spreading of the sack 7 on the filling pipe 5 is identified in FIG. 1 with the reference numeral 15*a*.

The separating arrangement shown in FIGS. 4–6 includes a vertically displaceable suction device and the table 2 shown in FIG. 1 and provided for receiving a stack of sacks 17. The table 2 is movable by a not shown drive in a horizontal plane transversely to the longitudinal edges of the sack of the stack of sacks 17. The drive is acted upon by a not shown control so that with a predetermined nominal position of the uppermost sack 17*a* of the stack of sacks 17, the table 2 is restrained in the respective position for receiving the sack by the suction device 8. In a not shown manner, the displaceability of the table 2 can be performed by running rollers arranged on the table 2. The running rollers must be supported on an abutment. In another structural modification, the table 2 can also be movable on two parallel guide rods arranged at a distance from one another.

The suction device 8 includes substantially a suction plate 8*a* which has a rectangular shape. In the shown embodiment it forms a lower limit of a suction box with which a suction 8*b* is connected. The suction pipe 8*b* is coupled with a vacuum pump. The vacuum which is formed there can be controlled by suitable not shown means in dependence upon the position of the suction device 8.

The suction device 8 is arranged on a holder 18 with a holding angle 19 screwed on the latter. Pins 20 extend at both sides of the free legs of the holding angle 19, which extend perpendicular to the table 2. A running roller 21 is freely rotatably mounted on the end region of each pin 20. Two rollers supported on the pin 20 together form a running roller pair. Two roller pairs spaced from one another form a guide for a pressure strip 22 which is movable transversely to the longitudinal edges of the sack of the stack of sacks 17. The pressing strip 22 is composed in the shown embodiment of a pipe with a square cross-section. The wall which is spaced from the table 2 and extends parallel to it is provided with a through going longitudinal slot, and the holding angle 19 which supports the pins 20 extends through this longitudinal slot. In the shown embodiment, a pressing strip 22 is provided on each longitudinal side of the suction plate 8*a*. As shown in FIG. 4, the front ends of the pressing strips 22 which face toward one another are connected with one another by a web 23, so that it can move in a plane which is parallel to the table 2 by a drive formed as a cylinder-piston unit 24.

It can be recognized from FIG. 5 that the pressure strips 22 are arranged on the suction device 8, and however are additionally movable relative to the suction device 8, for example by a not shown cylinder-piston unit. FIG. 5 shows the upper end position of the suction plate 8*a* with the pressure strips 22 placed on the stack of sacks 17.

An abutment is identified in FIGS. 5 and 6 with reference numeral 25. It is arranged on the table 11 and abuts against the sack of the stack of sacks 17 with a welding seam which faces toward the valve. The partially shown outer contour is identified in FIG. 6 with reference numeral 17*a*. The slot-shaped filling opening of the uppermost sack of the stack of sacks 17 is shown in dash-dot line and identified with reference 17*b*. The longitudinal edge of the sack 17*a*, which faces away of the filling opening 17*b*, has the reference 17*c*. A beam-shaped control mark 26 is pressed on the sack and extends in the shown embodiment parallel to the filling opening 17*b* of the valve. It is offset in direction toward the longitudinal edge 17*c* which faces away of the filling opening 17*b*. A light beam sensor 27 is mounted on the holder 18 and fixed relative to the movable table 2. As shown in FIG. 6, the light beam sensor 27 lies in the valve region of the sack 17*a*.

An opening lever 29 which is turnable about a horizontal axis 28 is arranged on the suction device 8. In the shown embodiment it is angular, and its free end is insertable into the filling opening 17*b* of the valve, as long as the filling opening is somewhat opened after the above performed movement of the suction plate 8*a*. The opening lever 19 engages for example, in the center of the filling opening 17*b*. However, in contrast to the shown embodiment it can be also offset relative to the center. The opening lever 29 is actuated by a cylinder-piston unit 30 which has a piston rod articulately connected with an actuating lever 31. The latter is arranged on the horizontal axis 28 for joint rotation therewith. FIG. 6 especially shows that the cylinder-piston unit 30 and the opening lever 29 are laterally offset relative to one another.

For removing the uppermost sack 17*a* of the stack of sacks 17, the table is displaced by the drive in a left end position, relative to the showing of FIG. 5. In this end position it is insured that the suction device 8 is inoperative. From this position the table 2 is moved in direction of the arrow A and then arrested when the light beam of the light beam sensor 27 hits the control mark 26. Since the control mark 26 is located always in the same position relative to the filling opening 17*b* of the valve, it is guaranteed that regardless of a displacement of the sack, each sack removed by the suction device 8 is located in the same position on the suction plate 8*a*. During the straightening movement of the table 2, the pressing strips 22 are displaced under the action of the not shown cylinder-piston units in direction toward the stack of sacks, so that the surfaces which face toward the stack of sacks 17 project relative to the suction plate 8*a*. During this movement of the table 2, the cylinder-piston unit 24 is deairated or pressureless, whereby the pressing strips 22 move by the friction in synchronism with the table 2. As long as the light beam of the light beam sensor 27 hits the control mark 26 and the table is stopped, the not shown cylinder-piston units for displacement of the pressure strips 22 in a vertical direction are deairated or made pressureless, and the suction plate 8*a* is lowered onto the stack of sacks 17. Under the action of the vacuum produced at this time, the uppermost sack 17*a* of the stack of sacks 17 is taken during an upward movement of the holder 18. Since the suction plate 8*a* engages in the valve region, the valve opens so that the opening lever 29 and subsequently the spreading fingers 9, 10 can be introduced into the valve. By means of the spreading device 3, the sack is then transported to the filling pipe and fitted onto it. As long as the uppermost sack 17 is taken by the suction plate 8*a*, the cylinder-piston unit 24 can be activated so that the pressure strips 22 can move in direction of the arrow B. Before they are placed on the stack of sacks 17, they can move back to their original initial position by reversing the cylinder-piston unit 24. After taking over of the sack by the spreading device 3, the holder 18 or the suction device 8 and thereby also the pressure strips 22 are lowered for separation of the next sack, and the not shown cylinder-piston units for vertical displacement of the pressure strips 22, are activated.

The double arrow D in FIG. 5 shows that the pressure strips 22 can be perform a relative movement in the vertical direction relative to the suction device 8 by a not shown drive. The arrow 10 shows that the suction device 8 is movable in a vertical direction for separation of the respective uppermost sack.

In contrast to the shown embodiment, it would also be possible to move the pressing strips 22 independently of the suction device 8. For this purpose, a further drive is however required. It should also be mentioned that the arrangement which includes substantially the separating device and the spreading device is controlled in synchronism with the filling machine.

The above described arrangement is especially suitable for series packaging machines. These packaging machines are normally provided with several filling pipes. For supplying the individual filling pipes, it can be very desirable in this case to activate the whole arrangement.

It will be understood that each of the elements described above, or two or more together, may also find a useful application in other types of constructions differing from the types described above.

While the invention has been illustrated and described as embodied in an arrangement for fitting valve sacks on filling pipes of packaging machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for fitting on a filling pipe of a packaging machine non-rigid side-fold valve sacks including each a valve, said arrangement comprising a displaceable spreading means having valve spreading elements insertable into a preliminary open value of a first valve sack separated from a valve sack stack for pulling up the valve, said spreading means being rotatable about a horizontal axis to position the value relative to the filling pipe, said arrangement further comprising means forming a horizontal guide path for supporting said spreading means for movement therealong for fitting the first value sack on the filling pipe.

2. An arrangement as defined in claim 2, wherein the filling pipe has a central longitudinal axis, said spreading means being turnable about said horizontal axis which extends parallel to and at a distance from said guide path and which is parallel to the central longitudinal axis of the filling pipe.

3. An arrangement as defined in claim 2, wherein said spreading means is turnable about said horizontal axis which is such that said horizontal axis is located under said guide path in a vertical projection.

4. An arrangement as defined in claim 3, wherein said guide means is formed as a shaft which is located above and laterally offset relative to the filling pipe; and further comprising a displacement sleeve arranged on said shaft and secured against rotation, said spreading means being mounted on said displacement sleeve.

5. An arrangement as defined in claim 4; and further comprising a mounting plate which is arranged so that said spreading means is mounted on said displacement sleeve of said mounting plate.

6. An arrangement as defined in claim 1 and further comprising a controllable drive arranged to move said spreading means along said guide path.

7. An arrangement as defined in claim 1 further comprising means for moving said spreading device towards the packaging machine to pick up another valve sack after the first valve sack has been fitted on the filling pipe.

8. An arrangement for fitting valve sacks on a filling pipe of a packaging machine, comprising means for spreading a valve of valve sacks, said spreading means being turnable about a horizontal axis so as to bring the valve of sacks in alignment with a filling pipe of a packaging machine; means forming a horizontal guide path for said spreading means; and means for moving said spreading means along said horizontal guide path, said spreading means including two spreading fingers which are movable relative to one another in a movement direction, and at least one pulling up hook which is movable transversely to said movement direction of said spreading fingers.

9. An arrangement as defined in claim 8, wherein said spreading fingers are formed as an angular members each having a free end which is insertable into the valve of the sacks.

10. An arrangement as defined in claim 8, wherein said pulling up hook is formed as an angular member having a free leg which is insertable into the valve of the sacks and formed as a circular segment which corresponds to an outer contour of the filling pipe.

11. An arrangement as defined in claim 8; and further comprising a cylinder-piston unit which is arranged on said spreading means and operative for moving said pulling up hook.

12. An arrangement for fitting valve sacks on a filling pipe of a packaging machine, comprising means for spreading a valve of valve sacks, said spreading means being turnable about a horizontal axis so as to bring the valve of sacks in alignment with a filling pipe of a packaging machine; means forming a horizontal guide path for said spreading means; means for moving said spreading means along said horizontal guide path; and means for separating individual sacks before spreading by said spreading means; said separating means including a substantially horizontal table for receiving a stack or several flatly lying sacks, a vertically movable suction device for lifting an uppermost sack from the stack, and at least one pressing strip which is placeable onto the stack of sacks in the region of the valve and movable in synchronism with said table.

13. An arrangement as defined in claim 12, wherein said separating means further include a drive and a control arranged for moving said table in a horizontal plane at least transversely to a longitudinal edge of the sack until a filling opening of the valve of an uppermost sack of the stack is in a proper position relative to said suction device.

14. An arrangement as defined in claim 12, wherein said separating means include a second such pressing strip, said pressing strips extend parallel to and at a distance from one another, and each of said pressing strips lying at a relatively small distance from a filling opening of the valve and perpendicularly to the filling opening, said separating means further including a drive operative for moving said pressing strips from the region of said suction device for transferring an uppermost sack to said spreading means.

15. An arrangement as defined in claim 14, wherein said pressing strips are connected with one another by a web, said drive for movement of said pressing strips including a cylinder-piston unit which engages said web.

16. An arrangement as defined in claim 12, wherein said pressing strip is arranged on said suction device.

17. An arrangement as defined in claim 12, wherein said suction device is formed as a suction plate which has a substantially rectangular contour and forms an upper limit of a suction box and a suction pipe.

18. An arrangement as defined in claim 12, wherein said separating means includes a vertically movable holder on which said pressing strip and said suction device are arranged, and an additional drive which moves said suction device relative to said pressing strip in a vertical direction.

19. An arrangement as defined in claim 12, wherein said spreading device has a drive for said table and a sensor arranged to sense a nominal position of a valve region of an uppermost sack and stop said drive of said table in response to said sensing.

20. An arrangement as defined in claim 19, wherein said sensor is formed as a light barrier sensor which operates in a contactless fashion.

21. An arrangement as defined in claim 19, wherein said sensor is formed so as to be associated with a control mark provided in the region of a valve of the uppermost sack.

22. An arrangement as defined in claim 12; and further comprising a second such pressing strip, each of said pressing strips being formed as a hollow profile rail, said suction device being provided with two spaced running rollers arranged at a distance from one another for each of said pressing strips so that each of said pressing strips is movable on a respective one of said running rollers.

23. An arrangement as defined in claim 22, wherein each of said running rollers is formed as a roller pair including two rolling members and a pin which freely rotatably supports said two rolling members.

24. An arrangement as defined in claim 12, wherein said pressing strip is movable in a plane which is parallel to said table.

25. An arrangement as defined in claim 12, wherein said separating means includes a drive operative for moving said pressing strip relative to said suction device in a vertical direction.

26. An arrangement as defined in claim 12; and further comprising an opening lever which is turnable about a horizontal axis and is associated with said separating means, said opening lever having a free end which is introducable into a pre-opened filling opening of the valve of the sacks.

27. An arrangement as defined in claim 26, wherein said opening lever is formed as an angular member.

28. An arrangement as defined in claim 27, wherein said opening lever is formed so that it lies in a central longitudinal axis of the valve of the sacks.

29. An arrangement as defined in claim 26; and further comprising drive means arranged to drive said opening lever and located in an outwardly offset relationship relative to said opening lever.

30. An arrangement as defined in claim 29, wherein said drive means of said opening lever is formed as a cylinder-piston unit.

31. An arrangement as defined in claim 13, wherein said drive and said control are formed so that said table is movable exclusively transversely to the longitudinal edge of the sack.

* * * * *